US010170025B2

(12) United States Patent
Reust et al.

(10) Patent No.: US 10,170,025 B2
(45) Date of Patent: Jan. 1, 2019

(54) SELECTION PANEL FOR A BEVERAGE DISPENSING DEVICE

(71) Applicant: NESTEC S.A., Vevey (CH)

(72) Inventors: Alexis Reust, Lausanne (CH); Olivier Girault, Vevey (CH); Roman Bachtold, Schonholzerswilen (CH)

(73) Assignee: Nestec S.A., Vevey (CH)

( * ) Notice: Subject to any disclaimer, the term of this patent is extended or adjusted under 35 U.S.C. 154(b) by 419 days.

(21) Appl. No.: 14/898,945

(22) PCT Filed: Jun. 24, 2014

(86) PCT No.: PCT/EP2014/063248

§ 371 (c)(1),
(2) Date: Dec. 16, 2015

(87) PCT Pub. No.: WO2014/206971

PCT Pub. Date: Dec. 31, 2014

(65) Prior Publication Data

US 2016/0372015 A1 Dec. 22, 2016

(30) Foreign Application Priority Data

Jun. 25, 2013 (EP) ..... 13173493

(51) Int. Cl.
*B67D 1/08* (2006.01)
*F21V 3/00* (2015.01)
(Continued)

(52) U.S. Cl.
CPC ..... *G09F 23/065* (2013.01); *B67D 1/0877* (2013.01); *F21V 3/00* (2013.01);
(Continued)

(58) Field of Classification Search
CPC ..... G09F 2013/142; G09F 2013/145; G09F 2013/222; G09F 2013/1836;
(Continued)

(56) References Cited

U.S. PATENT DOCUMENTS 4,326,620 A * 4/1982 Felix ..... G07F 9/10 194/344
4,682,709 A * 7/1987 Brandes ..... G09F 23/06 221/2
(Continued)

FOREIGN PATENT DOCUMENTS

JP 2006012063 1/2006
JP 2007025990 2/2007
JP 2008289677 12/2008

OTHER PUBLICATIONS

Machine translation of JP2007025990 retrieved from Espacenet.*

*Primary Examiner* — Alexander K Garlen
*Assistant Examiner* — Colin J Cattanach
(74) *Attorney, Agent, or Firm* — K&L Gates LLP

(57) ABSTRACT

The present invention relates to A selection panel (1) for a beverage dispensing device comprising a front window (2) having at least one display zone (3*a*) designed for displaying a product information label, at least one light source for illuminating the product information label arranged in the display zone (3*a*) of the front window (2), a reflector means (6) designed for reflecting the light emitted by the light source towards the display zone (3*a*) of the front window (2), wherein the light source is arranged outside of the contours of the respective display zone (3*a*).

11 Claims, 5 Drawing Sheets

(51) Int. Cl.

| | |
|---|---|
| ***F21V 7/00*** | (2006.01) |
| ***G09F 3/20*** | (2006.01) |
| ***G09F 13/14*** | (2006.01) |
| ***G09F 13/18*** | (2006.01) |
| ***G09F 13/22*** | (2006.01) |
| ***G09F 23/06*** | (2006.01) |
| ***F21Y 115/10*** | (2016.01) |

(52) U.S. Cl.
CPC ..... *F21V 7/0083* (2013.01); *G09F 3/201* (2013.01); *G09F 13/18* (2013.01); *F21Y 2115/10* (2016.08); *G09F 2013/145* (2013.01); *G09F 2013/222* (2013.01)

(58) Field of Classification Search
CPC ..... G09F 2013/1831; G09F 2013/1804; G09F 13/06; G09F 13/0422; G09F 13/049; G09F 13/18; G09F 23/065; F21V 7/0083; B67D 7/86; B67D 1/0872; B67D 1/0877; B67D 1/0875
See application file for complete search history.

(56) References Cited

U.S. PATENT DOCUMENTS

| | | | | | |
|---|---|---|---|---|---|
| 4,747,223 | A * | 5/1988 | Borda | G09F 13/12 | 40/219 |
| 4,835,661 | A * | 5/1989 | Fogelberg | G09F 13/04 | 362/223 |
| 4,909,604 | A * | 3/1990 | Kobayashi | F21V 7/00 | 349/64 |
| 5,943,801 | A * | 8/1999 | Wilkinson | G09F 13/04 | 40/564 |
| 6,257,737 | B1 * | 7/2001 | Marshall | F21S 8/04 | 362/231 |
| 6,618,972 | B2 * | 9/2003 | Bar-Yona | G07F 9/02 | 40/437 |
| 7,080,475 | B2 * | 7/2006 | Chirnomas | G07F 9/02 | 40/574 |
| 7,950,817 | B2 * | 5/2011 | Zulim | A47F 3/001 | 362/125 |
| 9,874,322 | B2 * | 1/2018 | Edmond | F21S 8/026 | |
| 2004/0025389 | A1 * | 2/2004 | Peterson | G09F 11/12 | 40/524 |
| 2004/0139640 | A1 * | 7/2004 | Myatt | G09F 3/20 | 40/611.01 |
| 2007/0070615 | A1 * | 3/2007 | Joslin | G07F 11/72 | 362/92 |
| 2009/0002990 | A1 * | 1/2009 | Becker | A47F 3/001 | 362/249.01 |
| 2010/0208490 | A1 * | 8/2010 | Tsuchiya | G02B 6/003 | 362/606 |
| 2011/0211335 | A1 * | 9/2011 | Ko | G02B 6/0046 | 362/97.1 |
| 2012/0236571 | A1 * | 9/2012 | Ling | G09F 27/005 | 362/307 |
| 2013/0058126 | A1 * | 3/2013 | Kim | G09F 3/14 | 362/602 |
| 2013/0265751 | A1 * | 10/2013 | Edmond | F21S 8/026 | 362/231 |
| 2014/0029305 | A1 * | 1/2014 | Ye | G02B 6/0046 | 362/619 |

* cited by examiner

SELECTION PANEL FOR A BEVERAGE DISPENSING DEVICE

CROSS REFERENCE TO RELATED APPLICATIONS

The present application is a National Stage of International Application No. PCT/EP2014/063248, filed on Jun. 24, 2014, which claims priority to European Patent Application No. 13173493.1, filed Jun. 25, 2013, the entire contents of which are being incorporated herein by reference.

FIELD OF INVENTION

The invention relates to a dispensing device for liquid comestibles having a selection panel for displaying product information. In particular, the invention relates to a selection panel comprising an enhanced illumination arrangement for the displayed product information.

BACKGROUND OF THE INVENTION

Beverage dispensing devices for preparing a liquid comestible such as coffee, tea, soup or the like are well known in the prior art. Beverage dispensing devices are also known which are designed for preparing and serving a multitude of different beverage-types among which the user or consumer may choose. In order to obtain such choice between different beverages or products to be prepared by the device, a user interface is usually provided at the dispensing device.

A known way of providing information and enabling a selection of a desired beverage type to be prepared by the dispensing device is the provision of a dedicated area or information zone which presents the labels of the different beverages that can be dispensed from or prepared by the device. These labels are usually paper-made labels that can be easily and cost-effectively changed. This is in particularly desired in case new or different beverage ingredients are provided to the device in order to enable the dispensing or preparation of a different beverage type.

The information area or zone in which the labels are presented may comprise a transparent window behind which the label is presented. The label may be held in place behind the window by dedicated connection means. In order to provide an enhanced readability and/or to obtain improved appearance of the label and the information presented thereon, a back light may be provided by means of which the label is illuminated.

WO 94/18647 for example describes a beverage discharging machine providing a multi-product respectively a multi-flavor selection front panel comprising a plurality of selection buttons and respective flavor label windows behind which are mounted product identification labels. The product identification labels are back lighted by dedicated illumination sources arranged directly behind the respective product identification labels.

This arrangement of the light source(s) does however not enable a very homogeneous label illumination and frequently the customer or user may observe a 'spot' of light on a particular zone of the label. From such appearance, the customer learns that the label provided behind a window is a paper label illuminated from behind, which provides a rather cheap aspect to the dispenser. Moreover, the readability of the identification label may be negatively affected.

Hence, a solution is sought-after which enables the provision of an enhanced illumination arrangement for labels of such beverage dispensing devices. Thereby, a homogenous light distribution of such a backlight over the whole area respectively surface of the label is particularly desired.

OBJECT AND SUMMARY OF THE INVENTION

The present invention seeks to address the above-described problems. The invention also aims at other objects and particularly the solution of other problems as will appear in the rest of the present description.

According to a first aspect, the invention relates to a selection panel according to the features of claim 1.

The light source is preferably arranged outside of the contours of the respective display zone when seen in top view onto the front window, i.e. a view perpendicular to a plane in which the front window is arranged.

According to the invention, a homogenous distribution of the light emitted by the respective light source is obtained. In particular, a homogenous distribution of light towards a respective display zone in which a product information label is arranged leads to an optimal illumination of a product information label.

Thereby, the user or customer gets the impression that the front window or panel which may comprise a plurality of such display zones being homogenously illuminated is a screen presenting the dedicated information on the product information labels arranged within the respective display zones.

Preferably the product information label is translucent. It is noted that the term "translucent product information label" encompasses any label made from a material which enables a transmission of at least a portion of light provided to a rear surface of the label to a front surface thereon.

The product information label is preferably made from translucent paper, cardboard or other suitable materials. The product information label is preferably a paper sheet label comprising imprinted product information.

The reflector means is preferably arranged at the rear side of the display zone in order to provide light emitted by the light source towards the rear side of a product information label arranged within the respective display zone. The light source for enabling an illumination of the respective display zone is preferably arranged at a lateral side of the respective display zone, i.e. outside the contours of the respective display zone. Accordingly to the invention, a uniform light distribution towards the rear surface of the respective display zone is obtained.

In a preferred embodiment, the light source is arranged with respect to the front window and/or the reflector means of the panel such that light emitted by the light source is essentially prevented from directly impinging on the respective display zone of the front window. Accordingly, the creation of undesired 'spots' on the product information label is prevented.

The main emission direction of the light emitted by the light source is preferably arranged essentially in parallel to a plane in which the front window lies.

The reflector means is arranged with respect to the front window such as to homogenously distribute the light provided by the respective light source towards a respective display zone.

According to the preferred embodiment the reflector consists in a recession extending in the rear of the respective display zone, wherein:

the outlines of said recession comprise a rear wall and lateral walls, said lateral walls raising from said rear wall up to the rear surface of the front window and said lateral walls comprising at least:

two side lateral walls parallel to the main emission direction of the light emitted by the light source, and one end lateral wall on the opposite side of the light source, and the rear wall (**6*a*3) and the end lateral wall (6*a*1**) join together according to a curved profile design.

The curve profile design is implicitly concave.

Preferably the rear wall and the end lateral wall present a surface configured for diffusing reflected light, that is for dividing the incident light beam in several reflected light beams with different orientations. This effect can be obtained with a rough surface or by structuring the geometry of the surface to get diffusion of the reflected light.

According to a particular implementation:

the end lateral wall abuts on the rear surface of the front window according to an angle α of about 25° with the plane (P) perpendicular to the front window, and the end of the rear wall next to the light source is designed such that it is oriented with an angle β of about 83° with the plane (P) perpendicular to the front window.

Preferably the rear wall of the recession is substantially parallel to the rear surface of the front window.

Preferably the side of the recession next to the light source is at least partially opened. This opening enables the emission of the light from the light source in direction of the reflector.

The plurality of associated reflector means is preferably assembled in a single piece of material.

The selection panel preferably comprises a plurality of light sources and display zones which are associated, such that a respective light source is designed for selectively illuminating only its associated display zone.

The display zones of the selection panel are preferably arranged directly adjacent to each other on the front window of the selection panel.

The reflector means preferably comprise at least one deflector designed for reflecting respectively deflecting the light emitted by the light source towards the display zone of the front window. The at least one deflector may be constituted by a recession formed in an essentially plane surface of the reflector.

The reflector means may comprise a plurality of deflectors which are each formed by a recession in the reflector designed for reflecting light of the respective light source towards the associated display zone of the front window. The deflectors are preferably hollowed portions in a unitary single piece constituting the reflector means. The unitary single piece constituting the reflector means is preferably of plate-like shape.

The reflector means are preferably reflective and/or diffusive. The reflector means preferably comprise a reflective and/or diffusive surface, in which the respective recessions forming the deflectors are formed. The reflector means may be made from a material such as aluminum. The surface of the reflector may as well be coated with a reflective medium such as a highly reflective white plastic coating.

The reflector means may further comprises shielding or delimitation means designed for preventing the provision of light emitted by a respective light source to a display zone not associated with the respective light source.

Thereby, an outer surface or boundary of a deflector of the reflector means is preferably in contact with respectively pressed against its associated product information label in order to prevent light from the associated light source to illuminate an adjacent product information label of the selection panel.

The light source of the selection panel is preferably a LED lamp. The LED lamp may comprise a single LED chip or a plurality of different LED chips. The LED chip(s) of the LED lamp may further comprise an applied color conversion layer. The LED lamp is preferably designed for emitting white light. The light source may further comprise a reflector having a preferably parabolic inner surface such as to concentrate the light bundle emitted by the LED chip in a specific direction.

As previously described, the selection panel may comprise a plurality of LED lamps wherein each LED lamp is arranged for illumination of an associated display zone of the front window. Accordingly, the respective LED lamps are preferably designed for providing light to their associated deflectors of the reflector means, which in turn provide the reflected light to a rear surface of the associated display zone of the front window.

The reflector means may be designed to be selectively connectable to the front window.

In a preferred embodiment, the reflector means are designed such as to support at least one product information label between a rear surface of the front window and a conformable shaped upper surface of the reflector means in a connected state of the front window and the reflector means. Accordingly, the at least one product information label is preferably arranged 'sandwiched' between an upper surface of the reflector means and a rear surface of the front window in their connected state. Thereby, the reflector means and/or the rear surface of the front window may comprise additional support means for supporting the respective product information label at a fixed position between the reflector means and the front window.

The front window is preferably made from a transparent glass.

The front window of the selection panel is preferably void of any demarcation between respective display zones. Accordingly, the transparent front glass does not present any demarcation associated to each label so that it is perceived by the customer as a homogenous screen and not as a divided glass panel.

The front window may however comprise a demarcation such as for example small protruding supportive wall members on the side facing the product information label(s) in order to improve the contact of each label with its associated deflector and furthermore prevent that light bypasses its associated deflector.

The beverage selection panel may further comprise dedicated selection buttons which are arranged in vicinity to the display zones of the panel. Alternatively, the selection panel may as well be equipped with dedicated sensor means for sensing a pressure on a dedicated display zone of the panel. Accordingly, the user or customer may choose a product by pressing onto/against the respective display zone of the selection panel.

In a further aspect, the invention relates to a beverage dispensing machine comprising a selection panel as described here-above.

Furthermore, also a vending machine may be equipped with a product selection panel according to the invention.

The machine preferably comprises a front door in which the front window of the selection panel is supported.

The reflector means is preferably movably attached to an inside surface of the front door by dedicated connection means. Accordingly, the reflector means are preferably designed to be brought from an open state in which a product information label may be placed onto the rear surface of the front window into a closed state in which the reflector means are brought in contact with a rear surface of the front window. In this closed state, the at least one product information label is preferably sandwiched between a rear surface of the front window and an upper surface of the reflector means.

Access to the product information labels respectively the sheet(s) of labels may thus be provided from the inside face of the front door of the machine. Accordingly, when the label(s) have to be changed, the operator may open the front door in order to disconnect the reflector means respectively the plate comprising the deflectors from the rear surface of the front window to get access to the label(s). The plate of deflectors may be attached to the inside of the front door by a hinge so that it can be easily pulled to open the assembly of the selection front panel and remove the product information label(s). The reflector means may further comprise a handle to facilitate its movement with respect to the front door and/or the front window.

The front door of the machine may further comprise at least one selection button arranged in vicinity to the respective display zone of the front window. Accordingly, the user or consumer may choose a product to be prepared and/or dispensed by means of the selection button placed in vicinity of the product information label in the dedicated display zone of the selection panel.

BRIEF DESCRIPTION OF THE DRAWINGS

Further features, advantages and objects of the present invention will become apparent for the skilled person when reading the following detailed description of embodiments of the present invention, when taken in conjunction with the figures of the enclosed drawings.

DETAILED DESCRIPTION OF EMBODIMENTS

Figure 1:
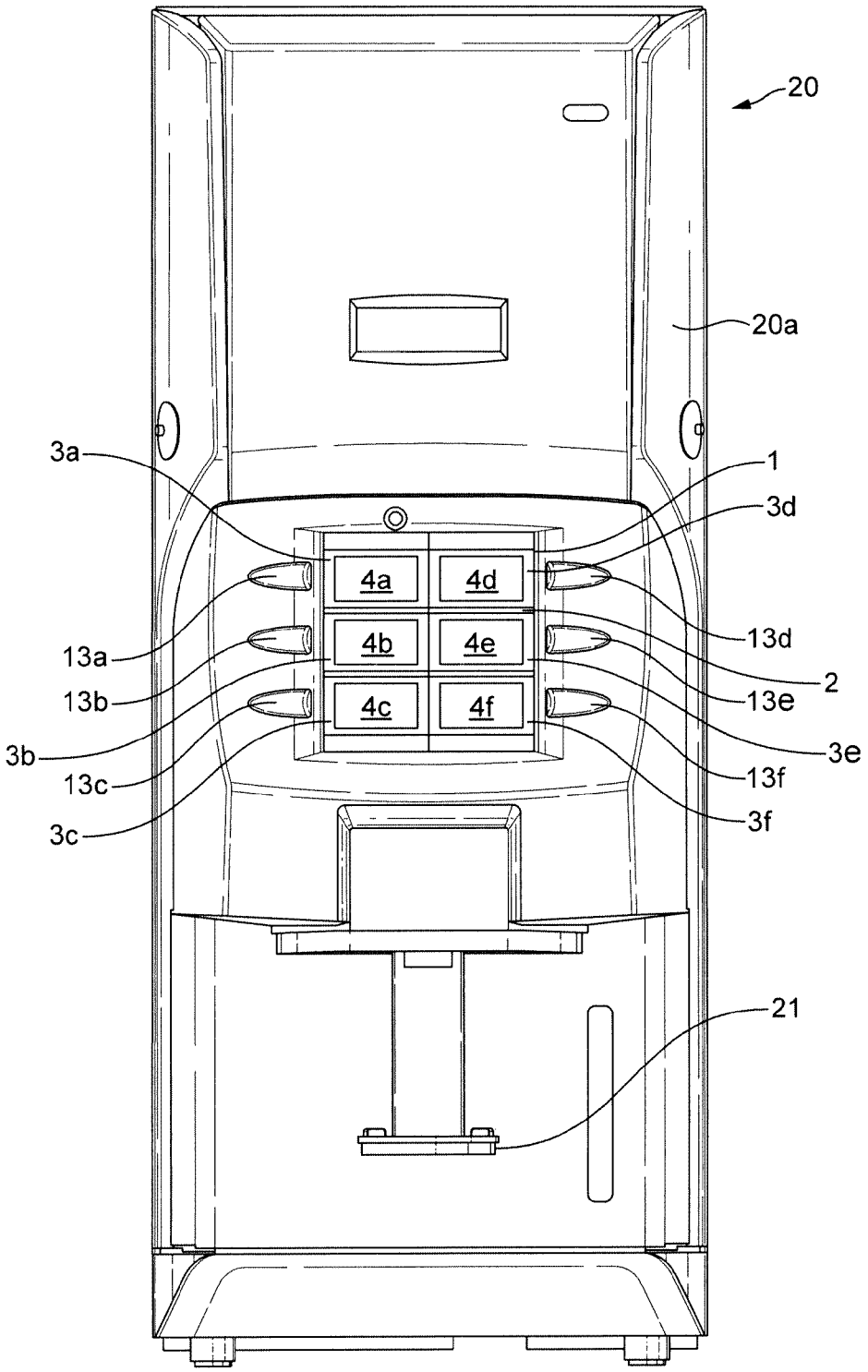
FIG. 1 shows a front view of a beverage preparation machine comprising a preferred embodiment of the selection panel according to the invention.

FIG. 1 relates to a front view of a beverage preparation machine 20 comprising a selection panel 1 according to the present invention. The selection panel 1 comprises a front window 2. The front window preferably comprises a plurality of display zones 3*a*, 3*b*, 3*c*, 3*d*, 3*e*, 3*f*. In the respective display zones of the panel, product information labels 4*a*, 4*b*, 4*c*, 4*d*, 4*e*, 4*f* are arranged. On the labels product information such as for example a product name or product sign is preferably imprinted. By means of illumination means to be further described below, an illumination of the respective display zone and thus, of the product information label arranged within the respective display zone is enabled.

The respective product information labels 4*a*, 4*b*, 4*c*, 4*d*, 4*e*, 4*f* indicated in FIG. 1 may be formed by a single label sheet.

Adjacent to the respective display zones 3*a*, 3*b*, 3*c*, 3*d*, 3*e*, 3*f*, buttons 13*a*, 13*b*, 13*c*, 13*d*, 13*e*, 13*f* are arranged for enabling a consumer or user to choose a selection based on the information displayed by the label within the respective display zone. As alternative to the indicated buttons 13*a*, 13*b*, 13*c*, 13*d*, 13*e*, 13*f*, the front window 2 may be equipped with sensor means for sensing a pressure applied to or contact of a human finger with one of the respective display zones in order to enable a selection of the desired beverage product.

The beverage preparation machine 20 is designed for preparing a plurality of different liquid comestibles such as for example different types of beverages. Thereby, the machine 20 may comprise at least a liquid reservoir, a pump, and a heating device such as a thermoblock.

The machine 20 comprises a housing 20*a* and a dispensing area 21 at which the selected beverage is provided. Thereby, the dispensing area may be designed to support and/or house a receptacle such as a cup in order to enable the dispensing into the provided receptacle by dedicated outlet means arranged at the dispensing area (not shown).

Figure 2:
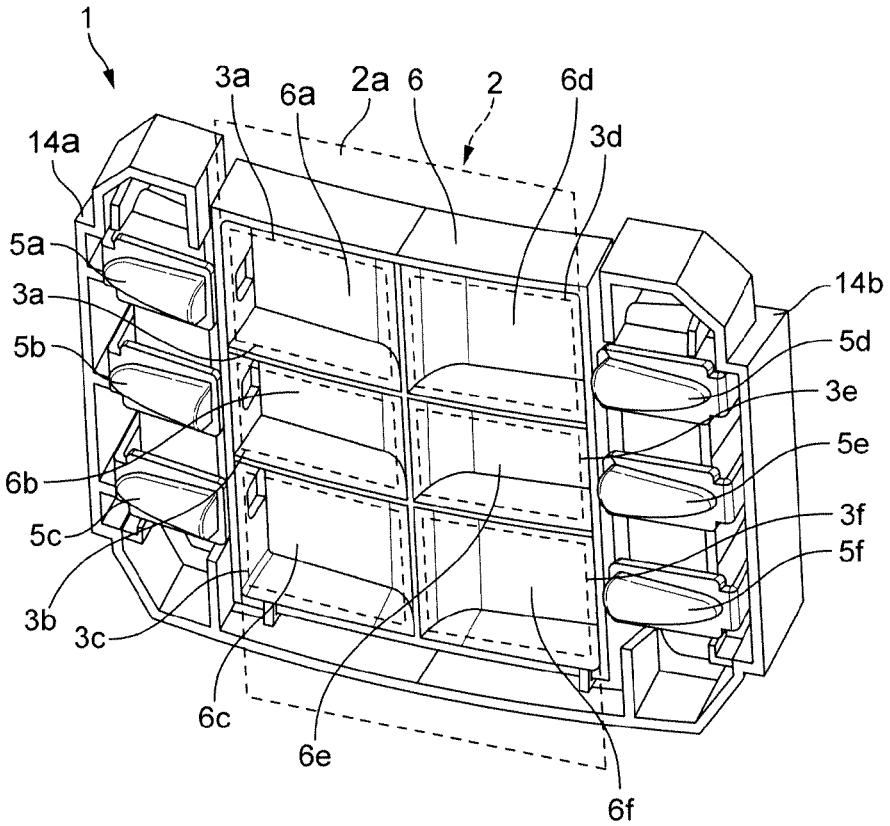
FIG. 2 shows a perspective side view of a preferred embodiment of the selection panel according to the invention.

FIG. 2 relates to a preferred embodiment of the selection panel 1 according to the invention. The front window 2 is divided in a plurality of display zones 3*a*, 3*b*, 3*c*, 3*d*, 3*e*, 3*f* indicated by the dotted lines in FIG. 2. The outer front surface of the window 2 is preferably void of any demarcation such as a wall member or the like. The outer surface is preferably flat or presents a smooth surface without any protrusions and/or recessions. The outer surface may as well be slightly bent.

The panel 1 further comprises an assembly 6 of reflector means which is preferably an integrally formed piece. The upper surface (see FIG. 3) of the assembly 6 is preferably formed conformable to a rear surface of the window 2. Thereby, the upper surface of the assembly 6 is preferably essentially flat or slightly bent. Accordingly, the reflector means 6 is designed to be in tight contact with the rear surface of the window 2 by means of the provided surface of the reflector means assembly 6.

The assembly 6 preferably comprises a plurality of reflectors means 6*a*, 6*b*, 6*c*, 6*d*, 6*e*, 6*f* which are cavities, all of these cavities presenting the same shape. The shape substantially corresponds to a parallepiped box wherein the face in front of the display zone is opened. Each of these reflectors means 6*a*, 6*b*, 6*c*, 6*d*, 6*e*, 6*f* is selectively illuminated by one corresponding light source 5*a*, 5*b*, 5*c*, 5*d*, 5*e*, 5*f*. The light sources 5*a*, 5*b*, 5*c*, 5*d*, 5*e*, 5*f* are arranged outside of the contours of the respective display zones 3*a*, 3*b*, 3*c*, 3*d*, 3*e*, 3*f*. The light sources are thus not arranged behind the respective display zones to be illuminated, but at the side of the respective display sources. The light sources are positioned at the external side of the cavities. For each box, the face of the box in front of the light source 5*a*, 5*b*, 5*c*, 5*d*, 5*e*, 5*f* is at least partially opened so that the light enters.

As shown in FIG. 2, the reflector means 6 are arranged with respect to the front window 2 such that the reflectors 6*a*, 6*b*, 6*c*, 6*d*, 6*e*, 6*f* are placed behind the respective display zones 3*a*, 3*b*, 3*c*, 3*d*, 3*e*, 3*f* of the front window 2. Accordingly, the reflectors are arranged to illuminate an associated rear surface portion of the window 2 and thus a rear surface portion of an associated display zone.

The light sources are preferably held by dedicated support members 14*a*, 14*b* arranged at the side of the reflector assembly 6. The support members 14*a*, 14*b* preferably hold the light sources 5*a*, 5*b*, 5*c*, 5*d*, 5*e*, 5*f* such that the emitted light is directed from the side of the reflector means 6 towards the reflectors 6*a*, 6*b*, 6*c*, 6*d*, 6*e*, 6*f* of the reflector means and thus to the rear surface of the window 2 corresponding to the display zone associated to the respective light source.

Figure 3:
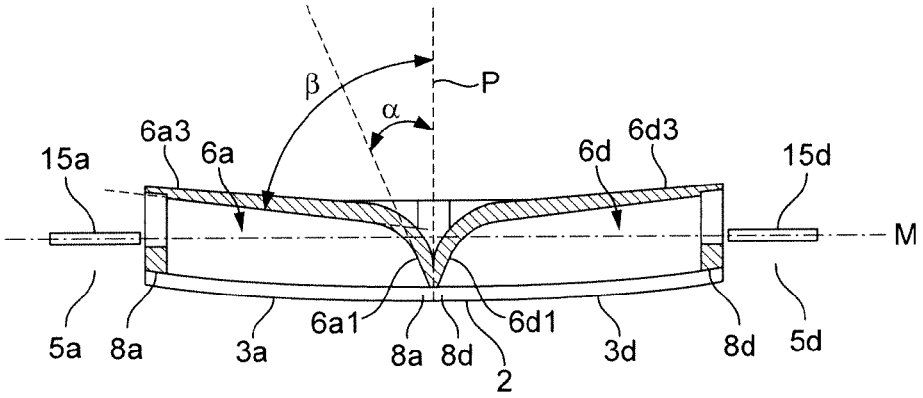
FIG. 3 shows a sectional top view onto a preferred embodiment of a selection panel according to the invention.

As indicated in FIG. 3, which shows a partial sectional top view of the device, preferably each of light sources 5*a*, 5*b*, 5*c*, 5*d*, 5*e*, 5*f* emits a bundle of light having a main emission direction respectively emission axis M, which is preferably essentially parallel to a plane in which the front window 2 is arranged.

The main emission direction of the respective light source 5*a*, 5*b*, 5*c*, 5*d*, 5*e*, 5*f* is preferably arranged at an angle less than 25°, more preferably less than 15° with respect to the inner surface of the front window 2 and/or with respect to a plane in which the front window 2 is arranged.

Figure 4:
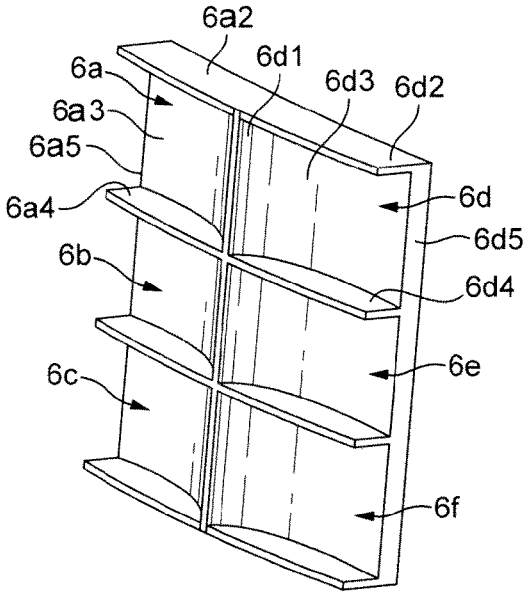
FIG. 4 shows a perspective side view of an assembly of reflector means according to the invention.

FIGS. 3 and 4 make apparent that each reflector means 6*a*, 6*d* consists in a recession extending in the rear of the respective display zone 3*a*, 3*d*. The outlines of each recession 6*a*, 6*d* respectively comprises a rear wall 6*a*3 and 6*d*3 and lateral walls 6*a*1, 6*a*2, 6*a*4 and 6*d*1, 6*d*2, 6*d*4. Preferably the rear wall 6*a*3, 6*d*3 of each recession 6*a*, 6*d* is substantially parallel to the rear surface of the front window 2 as apparent in FIG. 3.

For each recession the lateral walls 6*a*1, 6*a*2, 6*a*4 and 6*d*1, 6*d*2, 6*d*4 raises from its corresponding rear wall up 6*a*3 and 6*d*3 to the rear surface of the front window 2. For each recession 6*a*, 6*d* the lateral walls comprise:

- two side lateral walls 6*a*2, 6*a*4, respectively 6*d*2, 6*d*4, parallel to the main emission direction of the light emitted by the light source 5*a*, respectively 5*d*, (that is according to (M)), and
- one end lateral wall 6*a*1, respectively 6*d*1, on the opposite side of the light source 5*a*, respectively 5*d*.

For each recession 6*a*, 6*d*, the rear wall 6*a*3, respectively 6*d*3, and the end lateral wall 6*a*1, respectively 6*d*1, join together according to a curve profile design. This curved design is concave.

According to the preferred design:

- the end lateral wall 6*a*1 abuts on the rear surface of the front window 2 according to an angle α of about 25° with the plane (P) perpendicular to the front window 2, and
- the end of the rear wall 6*a*3 next to the light source 5*a* is designed such that it is oriented with an angle β of about 83° with the plane (P) perpendicular to the front window 2.

For each reflector the side 6*a*5 of the recession 6*a* next to its respective light source 5*a* is opened. It can be totally opened as illustrated in FIG. 4—then the recession 6*a* can present no lateral wall 6*a*5 as illustrated in FIG. 4—or it can present a lateral wall 6*a*5 that is partially opened for light emission as illustrated in FIGS. 2 and 3. The partial opening can improve illumination and presents also the interest of enabling the conformal cooperation of the reflector with the rear surface of window to maintain a label 4*a* in between.

The reflectors 6*a*, 6*d* lead to a deflection of the light emitted by the respective light source 5*a*, 5*d* towards the rear surface 2*a* of the front window 2 and thus, to the respective display zones 3*a*, 3*d*. Accordingly, a homogenous distribution of light towards the rear surface 2*a* of the respective display zone 3*a*, 3*d* is obtained.

FIG. 4 illustrates the preferred embodiment of a reflector assembly 6 of the invention. The reflector means 6 is preferably an integral piece made from metal plastic, preferably in a light colour. The reflector assembly 6 comprises a surface which is conformable formed to the rear surface of the window 2 in order to neatly sandwich a product information label between these surfaces.

The reflector means 6 further comprises shielding means 6*d*4, 6*e*5 for preventing the provision of light emitted by a respective light source to a display zone not associated with the respective light source. Such shielding means are formed by the upper and lower faces of the cavities of the reflector means 6*d*, 6*e*.

In case the reflector means 6 are in contact with the rear surface of the window 2, the shielding means 7*a* may thus prevent the provision of light from a first deflector to a neighboring deflector or display zone.

Figure 5:
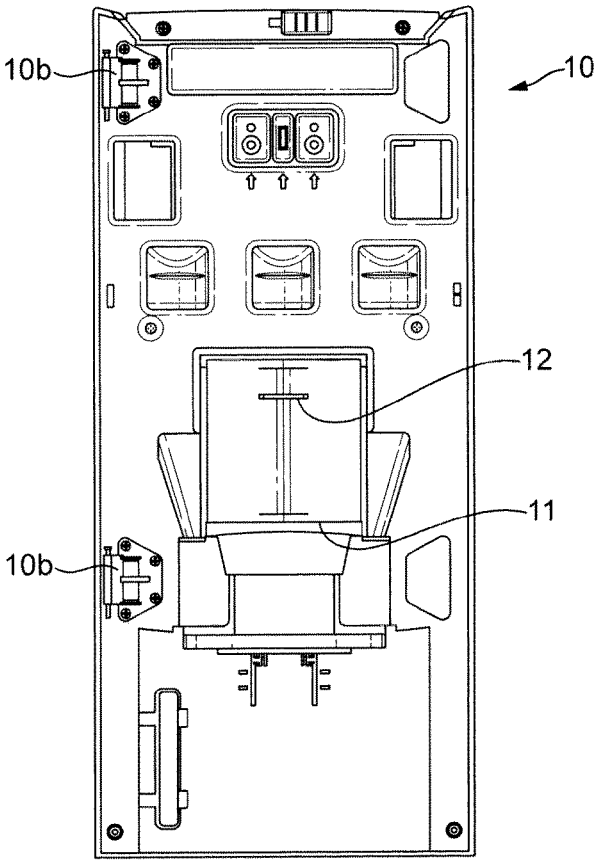
FIG. 5 shows a rear view onto the front door of a beverage machine according to the invention.

FIG. 5 relates to a rear view onto the front door 10 of a beverage machine 20 according to the invention. The front door 10 may be connected to the housing 20*a* by means of joints 10*b* formed at the inside face 10*a* of the front door 10. Accordingly, the front door is movably attached to the housing 20*a*.

The front door 10 is designed to support the front window 2 of the selection panel. Thereby, dedicated support means may be arranged at the circumference of the front window 2 in order to fixedly connect the window 2, as well as the selection panel 1.

Figure 6:
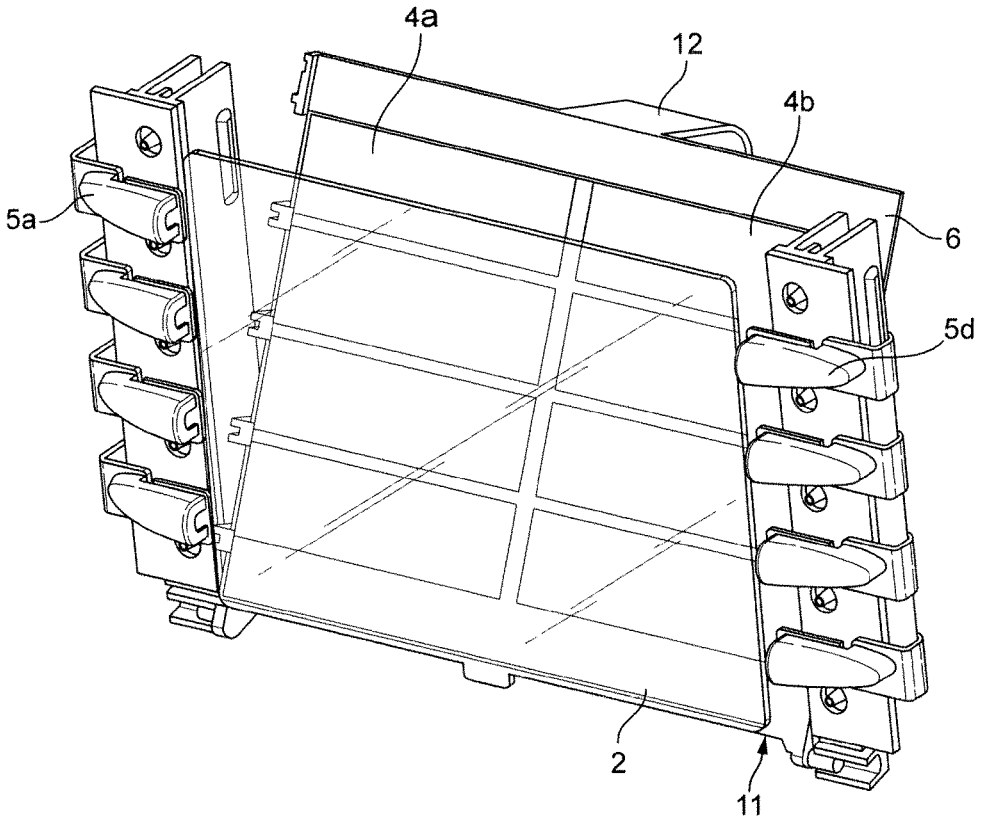
FIG. 6 shows a perspective side view of the selection panel according to the invention during the step of replacement of the labels.

The assembly of reflector 6 is preferably movably connected to the inside face 10*a* of the front door 10 by dedicated connection means 11 as illustrated in FIG. 6. For example a hinge or joint member 11 may be provided for selectively connecting the reflector assembly 6 to the front window 2 respectively to the front door 10 such as to be in contact with the rear surface 2*a* of the front window 2. Accordingly, the reflector assembly 6 is designed to be brought from an open state in which a product information label 4*a*, 4*b*, 4*c*, 4*d*, 4*e*, 4*f* may be placed onto the rear surface of the front window 2 into a closed state in which the reflector assembly 6 is brought in contact with the rear surface of the front window 2. In this closed state, the at least one product information label is preferably sandwiched between the rear surface of the front window 2 and the upper surface of the reflector assembly.

Access to the product information labels respectively the sheet(s) of labels may thus be provided from the inside face 10*a* of the front door 10 of the machine. The reflector assembly 6 may be attached to the inside of the front door 10*a* by a hinge 11 so that it can be easily pulled to open the assembly of the selection front panel and remove the product information label(s). The reflector assembly 6 may also comprise a handle 12 to facilitate its movement with respect to the front door 10 and/or the front window 2.

Figure 7:
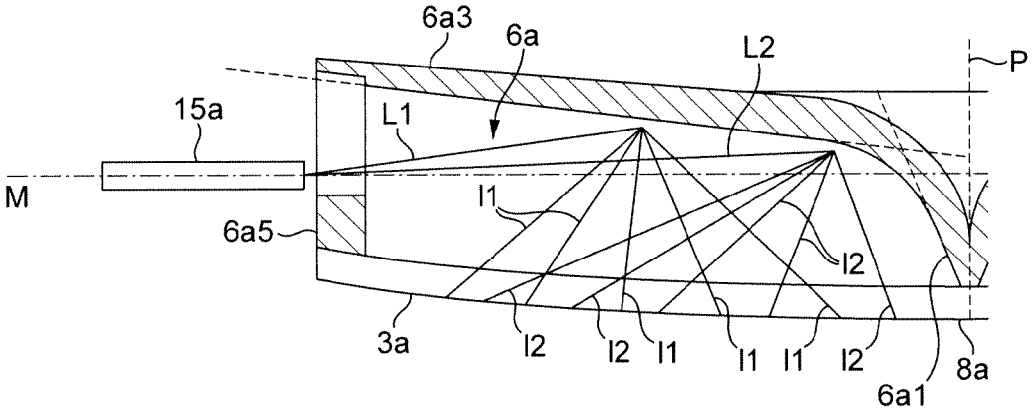
FIG. 7 shows the reflection of two light beams on the reflector.

FIG. 7 is a part of FIG. 3 in which the paths of two light beams L1, L2 have been illustrated. Each beam L1, L2 is reflected on the rear wall 6*a*3 and on the end lateral wall 6*a*1 as a plurality of sub-beams I1, I2 respectively. Due to the orientation of the reflecting walls 6*a*1, 6*a*3 compared to the emission axis M and the curved shape between said walls, light beam L1 reflecting on rear wall 6*a*3 creates sub-beams I1 homogeneously distributed on the display zone 3*a*, whereas light beam L2 reflecting on rear wall 6*a*1 creates sub-beams I2 essentially distributed on the left part of the display zone 3*a* closest to the side 6*a*5 of the reflector. As a consequence display zone 3*a* is finally homogeneously crossed by reflected sub-beams I1 and I2 and no spot of light appears on said display zone for the user looking at the display zone from the exterior. A label positioned between along the surface of the display zone 3*a* is homogeneously illuminated.

Although the present invention has been described with reference to preferred embodiments thereof, many modifications and alternations may be made by a person having ordinary skill in the art without departing from the scope of this invention which is defined by the appended claims.

The invention claimed is:

1. A beverage dispensing machine comprising a selection panel comprising a front window, the front window comprising:

at least one display zone designed for displaying a product information label;

at least one light source for illuminating the product information label arranged in the at least one display zone of the front window, the at least one light source being arranged outside of contours of the at least one display zone; and a reflector associated with the at least one light source designed for reflecting light emitted by the at least one light source towards the at least one display zone of the front window, wherein:

the reflector is located in a recession extending in a rear of the at least one display zone, outlines of the recession comprising a side of introduction of the light emitted by the at least one light source, a rear wall and lateral walls, the lateral walls raising from the rear wall up to a rear surface of the front window, and the lateral walls comprising at least two side lateral walls parallel to a main emission direction of the light emitted by the at least one light source, and the lateral walls further comprising an end lateral wall on an opposite side of introduction of the light emitted by the at least one light source, and the rear wall and the end lateral wall joining together according to a curved profile design, wherein the reflector is connectable to the front window to support the product information label between the rear surface of the front window and a conformable shaped upper surface of the reflector, the beverage dispensing machine comprises a front door in which the front window of the selection panel is supported, and the reflector is moveably attached to an inside face of the front door by a dedicated connection.

2. The beverage dispensing machine according to claim 1, wherein the front door of the beverage dispensing machine comprises at least one selection button arranged in vicinity to the at least one display zone of the front window.

3. The beverage dispensing machine according to claim 1, wherein the main emission direction of the light emitted by the at least one light source is arranged substantially parallel to a plane in which the front window is arranged.

4. The beverage dispensing machine according to claim 1, wherein the reflector is arranged with respect to the front window such as to homogeneously distribute the light emitted by the at least one light source towards the at least one display zone.

5. The beverage dispensing machine according to claim 1, wherein in the recession, the side of introduction of the light emitted by the at least one light source is at least partially opened.

6. The beverage dispensing machine according to claim 1, wherein:

the end lateral wall abuts on the rear surface of the front window according to an angle $\alpha$ of about 25° with a plane perpendicular to the front window, and an end of the rear wall next to the at least one light source is designed such that it is oriented with an angle $\beta$ of about 83° with the plane perpendicular to the front window.

7. The beverage dispensing machine according to claim 1, wherein the rear wall and the end lateral wall present a surface configured for diffusing reflected light.

8. The beverage dispensing machine according to claim 1, wherein the selection panel comprises a plurality of light sources, a plurality of associated display zones and a plurality of associated reflectors.

9. The beverage dispensing machine according to claim 1, wherein a plurality of associated reflectors is assembled in a single piece of material.

10. The beverage dispensing machine according to claim 1, wherein the at least one light source is an LED lamp.

11. The beverage dispensing machine according to claim 1, wherein the front window is void of any demarcation between respective display zones.

* * * * *